US009638090B2

(12) United States Patent
Kim

(10) Patent No.: US 9,638,090 B2
(45) Date of Patent: May 2, 2017

(54) APPARATUS AND METHOD FOR IMPROVING EFFICIENCY OF ALTERNATOR FOR VEHICLE

(71) Applicants: HYUNDAI MOTOR COMPANY, Seoul (KR); Kia Motors Corporation, Seoul (KR)

(72) Inventor: Hyun Kim, Hwaseong-Si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 63 days.

(21) Appl. No.: 14/720,683

(22) Filed: May 22, 2015

(65) Prior Publication Data

US 2016/0138459 A1 May 19, 2016

(30) Foreign Application Priority Data

Nov. 17, 2014 (KR) ..... 10-2014-0159889

(51) Int. Cl.

| | |
|---|---|
| ***F01P 7/02*** | (2006.01) |
| ***F01P 7/10*** | (2006.01) |
| ***F01P 7/04*** | (2006.01) |
| *F01P 1/00* | (2006.01) |

(52) U.S. Cl.

CPC *F01P 7/10* (2013.01); *F01P 7/04* (2013.01); *F01P 2001/005* (2013.01); *F01P 2025/08* (2013.01)

(58) Field of Classification Search

CPC .. F01P 7/10; F01P 7/04; F01P 2025/08; F01P 2001/005

See application file for complete search history.

(56) References Cited

U.S. PATENT DOCUMENTS

2004/0217740 A1* 11/2004 Wilson ..... H02P 9/006 322/37
2016/0043612 A1* 2/2016 Gagnon ..... H02K 9/04 310/53

FOREIGN PATENT DOCUMENTS

| | | | |
|---|---|---|---|
| JP | 03270659 | A * | 12/1991 |
| JP | 2010-083341 | A | 4/2010 |
| JP | 2014-088160 | A | 5/2014 |
| KR | 10-2003-0033763 | A | 5/2003 |
| KR | 10-0715656 | B1 | 5/2007 |

OTHER PUBLICATIONS

Korean Office Action dated Nov. 18, 2015 issued in Korean Patent Application No. 10-2014-0159889.

* cited by examiner

*Primary Examiner* — Hung Q Nguyen

(74) *Attorney, Agent, or Firm* — McDermott Will & Emery LLP

(57) ABSTRACT

An apparatus for improving efficiency of an alternator for a vehicle includes a controller connected to the alternator by LIN communication to determine whether the alternator enters a high temperature condition. The controller operates a cooler to cool an inside of an engine room if it is determined that the alternator enters the high temperature condition.

5 Claims, 2 Drawing Sheets

-- Related Art --

APPARATUS AND METHOD FOR IMPROVING EFFICIENCY OF ALTERNATOR FOR VEHICLE

CROSS-REFERENCE(S) TO RELATED APPLICATIONS

The present application claims the benefit of priority to Korean Patent Application Number 10-2014-0159889 filed on Nov. 17, 2014, the entire content of which application is incorporated herein for all purposes by this reference.

TECHNICAL FIELD

The present disclosure relates to an apparatus and a method for improving efficiency of an alternator for a vehicle, and more particularly, to an apparatus and a method for improving efficiency of an alternator for a vehicle capable of improving efficiency and durability of the alternator by performing a temperature reducing control of the alternator when an operation of the alternator stops in a high temperature condition.

BACKGROUND

A vehicle is equipped with a power generation control system which stops power generation of an alternator during acceleration and charges a battery by the power generation of the alternator during deceleration to improve efficiency of the vehicle. Recently, a local interconnect network (LIN) communication alternator, which controls transmission of a digital value through an LIN communication line between the alternator and an engine ECU, has been actively developed.

A power generation control technology of variably controlling power generation of an alternator has been applied to improve efficiency of a vehicle.

This technology reduces a mechanical load applied to a vehicle by stopping the power generation of the alternator at the time of acceleration so as to improve acceleration performance and uses a load torque generated from the alternator by maximizing the power generation of the alternator at the time of deceleration so as to improve deceleration performance, thereby improving the efficiency of a vehicle.

In the case of the typical power generation technology, as illustrated in FIG. 1, signal lines of an alternator 1 and an engine control unit (ECU) 2, respectively, are connected to each other by a wire to control power generation using a pulse-width modulation (PWM) signal. An FR line is a line through which an internal power generation state related signal of the alternator 1 is transmitted to the ECU 2, and a C line is a line through which a power generation control function performance related signal is transmitted from the ECU 2 to the alternator 1.

However, the above technology may not receive a fault condition in alternator hardware or information on a self-protection function, and therefore, a separate control may not be made.

That is, the alternator which is an electrical component may have problems due to electrical errors, mechanical errors, and high temperature exposure inside the alternator. The contents described as the related art have been provided only for assisting in the understanding for the background of the present disclosure and should not be considered as corresponding to the related art known to those skilled in the art.

SUMMARY

An aspect of the present inventive concept provides an apparatus and a method for improving efficiency of an alternator for a vehicle capable of improving efficiency and durability of the alternator by performing a temperature reducing control of the alternator when an operation of the alternator stops for self protection in response to a high temperature condition of the alternator.

Other objects and advantages of the present inventive concept can be understood by the following description, and become apparent with reference to the embodiments of the present inventive concept. Also, it is obvious to those skilled in the art to which the present disclosure pertains that the objects and advantages of the present inventive concept can be realized by the means as claimed and combinations thereof.

In accordance with an embodiment of the present inventive concept, an apparatus for improving efficiency of an alternator for a vehicle includes: a controller connected to the alternator by local interconnect network (LIN) communication to determine whether the alternator enters a high temperature condition. The controller operates a cooler to cool an inside of an engine room if it is determined that the alternator enters the high temperature condition.

The controller may determine that the alternator is in the high temperature condition when a high temperature condition message is transmitted from the alternator.

The cooler may be at least one of a cooling fan, a forced cooling controller for a cooling water temperature, and an active air flap.

The controller may control the cooling fan to be operated in a highest mode if it is determined that the alternator enters the high temperature condition.

The controller may forcibly cool the cooling water temperature to control an engine to be cooled if it is determined that the alternator enters the high temperature condition.

The controller may cool the active air flap to be opened if it is determined that the alternator enters the high temperature condition.

In accordance with another embodiment of the present inventive concept, a method for improving efficiency of an alternator for a vehicle includes determining whether the alternator enters a high temperature condition by connecting the alternator to an engine control unit (ECU) by LIN communication. An inside of an engine room is cooled by operating a cooler if it is determined that the alternator enters the high temperature condition.

DETAILED DESCRIPTION

Exemplary embodiments of the present inventive concept will be described in detail with reference to the accompanying drawings.

An apparatus for improving efficiency of an alternator for a vehicle according to an exemplary embodiment of the present inventive concept may include an alternator 10, a controller 20, and a cooler.

Figure 1:
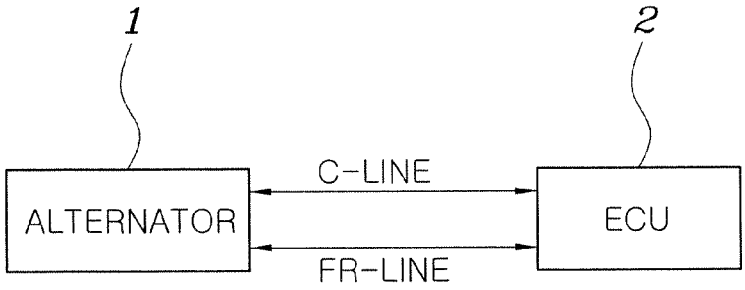
FIG. 1 is a diagram schematically illustrating a power generation control system of an alternator according to the related art.
Figure 2:
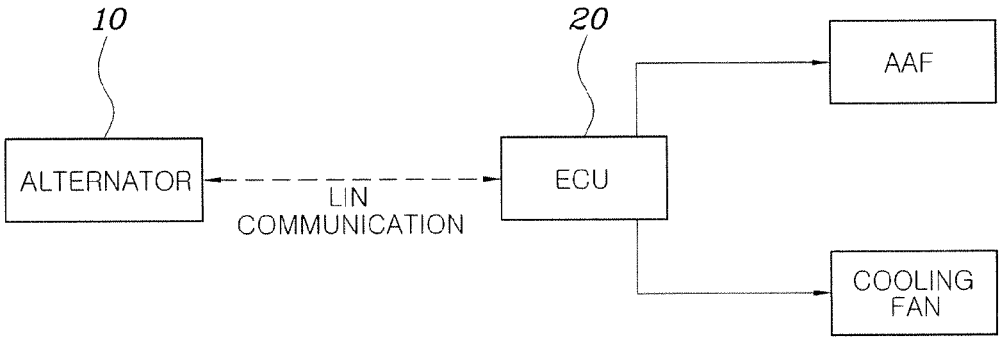
FIG. 2 is a diagram schematically illustrating a configuration of a control system of an alternator for a vehicle according to an exemplary embodiment of the present inventive concept and a cooler connected to a controller.

Referring to FIG. 2, the alternator 10 may be equipped in the vehicle and is connected to the controller 20 by communication. The communication may be local interconnect network (LIN) communication.

In particular, the controller 20 determines whether the alternator 10 enters a high temperature condition by the above communication and if it is determined that the alternator 10 enters the high temperature condition, operates the cooler to control an inside of an engine room to be cooled.

Here, the controller 20 may be an engine control unit (ECU).

Further, when the controller 20 receives a high temperature condition message transmitted from the alternator 10, the controller 20 may determine that the alternator 10 is in the high temperature condition.

That is, in the case of the LIN communication type, unlike the typical technology, when power is not generated normally due to the occurrence of errors of the alternator, the ECU may receive the corresponding state message by the LIN communication to monitor the corresponding state.

Further, the cooler may be at least one of a cooling fan, a forced cooling control of cooling water temperature, and an active air flap.

That is, as an exemplary example of cooling the engine room, if the controller 20 determines that the alternator 10 enters the high temperature condition, the controller 20 controls the cooling fan to be operated at a highest mode to reduce the cooling water temperature.

As another example, the cooler 20 may control the engine to be cooled by forcibly cooling the cooling water temperature. In this case, the forced cooling control of cooling water temperature is just an example, but there may be a control method for forcibly flowing cooling water into a radiator by controlling an opening temperature of an electronic thermostat. In addition, the known forced cooling method of cooling water temperature may be applied.

As another example, the controller 20 may control an active air flap (AAF) to be opened.

A method for improving efficiency of an alternator for a vehicle according to an exemplary embodiment of the present inventive concept may include steps of determining (S10) and controlling cooling (S20).

In the step of determining (S10), the alternator 10 is connected to the ECU 20 by the LIN communication to determine whether the alternator 10 enters the high temperature condition.

In the step of controlling of the cooling (S20), if it is determined that the alternator 10 enters the high temperature condition, the cooler is operated to control an inside of the engine room to be cooled.

Hereinafter, an action and effect of the present disclosure will be described in more detail.

A message received from the alternator to the engine ECU, in particular, a fast Hadamard transform (FHT) message is a message representing the high temperature condition in the alternator and when the temperature of the alternator is a higher temperature condition than an operation area, the alternator stops power generation for a self-protection function and transmits a value of FHT=1 to the engine ECU. The value of FHT=1 is the high temperature alternator operation stopping error signal. When the state is continued, the battery is not charged, a warning light informing that a battery voltage is low is turned on, and a problem of power instability of the vehicle and a customer claim is caused.

Further, under the FHT=1 condition, when the alternator enters frequently the high temperature condition, the durability of the alternator is remarkably reduced.

Figure 3:
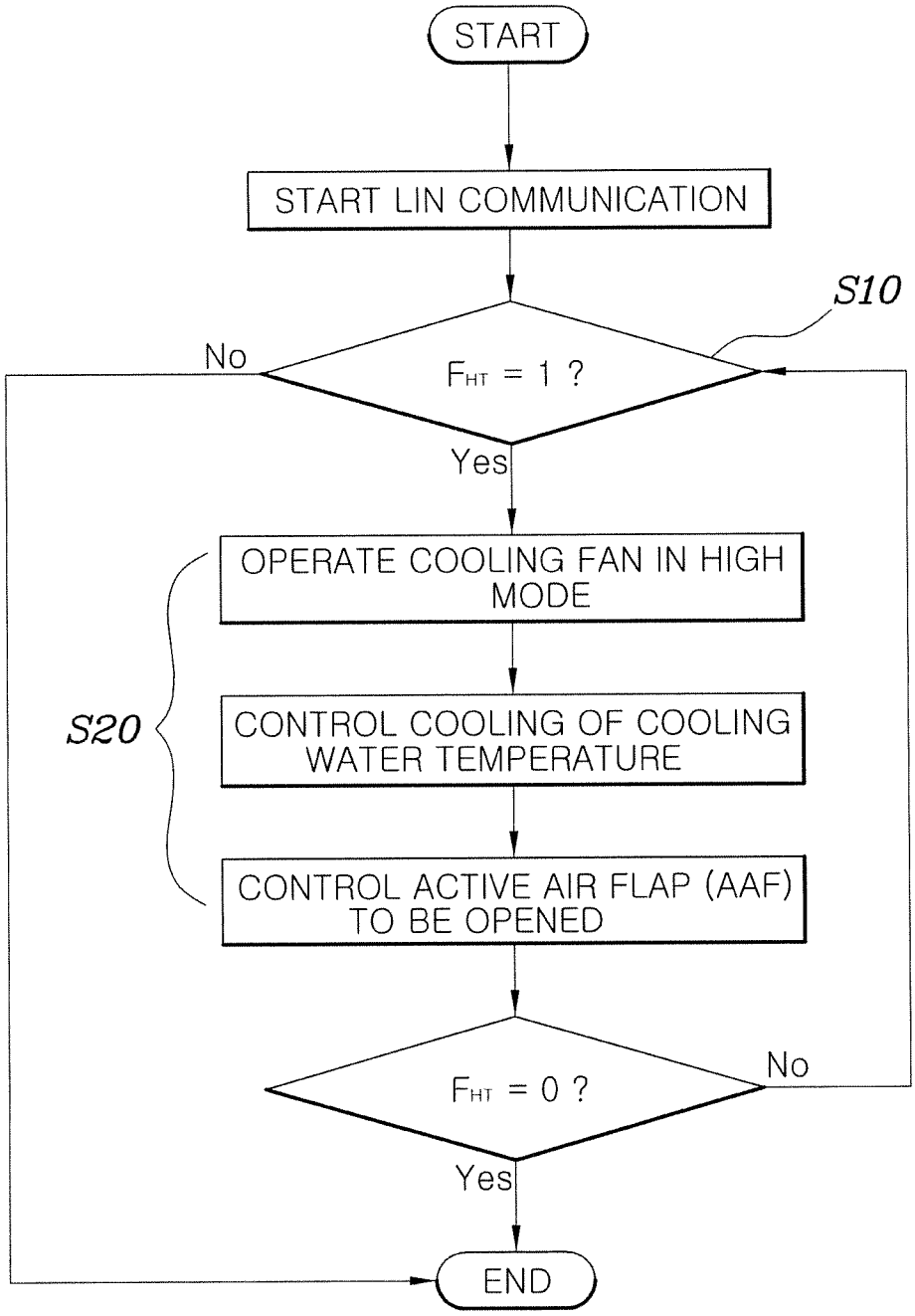
FIG. 3 is a flow chart of a method for improving efficiency of an alternator for a vehicle according to an exemplary embodiment of the present inventive concept.

Therefore, according to the exemplary embodiment of the present inventive concept, as illustrated in FIG. 3, it is determined that the alternator is in the high temperature condition by the LIN communication (S10) and when the engine ECU receives the high temperature condition message of the alternator, the engine ECU controls the cooling fan, the AAF, and the engine cooling water temperature to reduce the temperature of the engine room, thereby reducing the temperature of the alternator (S20).

That is, when the message of FHT=1 is received, the engine ECU controls the cooling fan in a high mode, controls the active air flap to be opened, and enters the control to reduce the overall temperature of the engine room using the forced cooling of the cooling water temperature of the engine.

Therefore, according to the exemplary embodiment of the present inventive concept, the engine ECU performs the control to meet the condition characteristics of the alternator using the LIN communication message of the alternator to prevent the alternator from being exposed for a long period of time under the high temperature condition, thereby preventing a poor charging problem of a battery of the vehicle, increasing durability of the alternator, and reducing the occurrence frequency of the problems.

According to the exemplary embodiments of the present inventive concept, it is possible to reduce the alternator temperature by the alternator temperature cooling at the time of the occurrence of the high temperature failure of the alternator so as to reduce durability deterioration and any cost for the alternator due to the frequent operation stopping and enlarge the use area of the alternator to improve the charging and discharging performance, by monitoring the operation stopping condition due to the high temperature fail of the alternator using the alternator signal by the LIN communication.

Although specific examples of the present inventive concept have been described above in detail, it is obvious to those skilled in the art that various modifications and alterations may be made without departing from the spirit and scope of the present disclosure. In addition, it is obvious that these modifications and alterations are within the following claims.

What is claimed is:

1. An apparatus for improving efficiency of an alternator for vehicles, comprising:

a controller configured to be connected to the alternator by local interconnect network (LIN) communication to determine whether the alternator enters a high temperature condition, wherein the controller is configured to operate a cooler to cool an inside of an engine room if it is determined that the alternator enters the high temperature condition, and wherein the cooler includes a cooling fan, a forced cooling controller of cooling water temperature, and an active air flap.

2. The apparatus of claim 1, wherein the controller determines that the alternator is in the high temperature condition when a high temperature condition message is transmitted from the alternator.

3. The apparatus of claim 1, wherein the controller controls the cooling fan to be operated in a highest mode if it is determined that the alternator enters the high temperature condition.

4. The apparatus of claim 1, wherein the controller forcibly cools the cooling water temperature to control an engine to be cooled if it is determined that the alternator enters the high temperature condition.

5. The apparatus of claim 1, wherein the controller controls the active air flap to be opened if it is determined that the alternator enters the high temperature condition.

* * * * *